US007997305B2

(12) United States Patent
Haramis et al.

(10) Patent No.: US 7,997,305 B2
(45) Date of Patent: Aug. 16, 2011

(54) DRINK LAYERING POTION MACHINE

(76) Inventors: Christopher C. Haramis, Wayne, NJ (US); Matthew N. Haramis, Wayne, NJ (US)

( * ) Notice: Subject to any disclaimer, the term of this patent is extended or adjusted under 35 U.S.C. 154(b) by 668 days.

(21) Appl. No.: 12/006,645

(22) Filed: Jan. 4, 2008

(65) Prior Publication Data

US 2009/0211662 A1 Aug. 27, 2009

(51) Int. Cl.
*B65B 3/04* (2006.01)

(52) U.S. Cl. ..... 141/100; 141/9; 141/106; 141/247; 141/340

(58) Field of Classification Search ..... 141/9, 100, 141/105, 106, 247, 331, 339–341, 391
See application file for complete search history.

(56) References Cited

U.S. PATENT DOCUMENTS

| | | | | |
|---|---|---|---|---|
| 654,879 | A | 7/1900 | Dineen | 141/284 |
| 1,664,266 | A | 3/1928 | Del Rio | 141/204 |
| 2,740,571 | A | 4/1956 | Busto | 141/94 |
| 2,771,913 | A | 11/1956 | Flasnocker | 141/9 |
| 3,185,189 | A | 5/1965 | Reid | 141/100 |
| 3,256,916 | A * | 6/1966 | Silletti | 141/100 |
| 4,050,484 | A | 9/1977 | Danyo | 141/34 |
| 4,126,164 | A | 11/1978 | Magnifico | 141/286 |
| 4,337,806 | A | 7/1982 | Cirella | 141/286 |
| 4,469,151 | A | 9/1984 | Wilson et al. | 141/286 |
| 4,800,934 | A | 1/1989 | Boissoneault | 141/106 |
| D317,103 | S | 5/1991 | Case | D7/643 |
| 5,163,488 | A | 11/1992 | Basch | 141/100 |
| 6,220,147 | B1 * | 4/2001 | Priley | 99/323 |
| 6,840,158 | B2 * | 1/2005 | Cai | 99/323.1 |
| 2007/0235103 | A1 * | 10/2007 | Taverna | 141/100 |

* cited by examiner

*Primary Examiner* — Gregory L Huson
*Assistant Examiner* — Nicolas A Arnett
(74) *Attorney, Agent, or Firm* — Ernest D. Buff; Ernest D. Buff & Associates LLC; Margaret A. LaCroix

(57) ABSTRACT

A drink layering potion machine reliably creates undisturbed air bubble free multiple drink layers. The potion machine includes a flat bottom hollow cylinder, a top with an integral conical pouring cup having a central aperture at its bottom tip. A thin rod passes through the aperture with a small clearance. A second aperture displaced from the first aperture supports thin rod providing wobble free movement. The bottom end of the thin rod carries a float. The drink layering potion machine is placed with a hollow cylinder encircling a glass and stabilizing it from tilting. The float rests on the liquor in the interior of the glass as liquor is poured into the conical pouring cup. The liquor runs down at a slow volumetric rate through the small clearance, down the thin rod, over the float external surface into the glass forming layered undisturbed drink free from air bubble entrapment.

14 Claims, 3 Drawing Sheets

DRINK LAYERING POTION MACHINE

BACKGROUND OF THE INVENTION

1. Field of the Invention

The present invention relates to a potion machine system for layering drinks in discrete layers in a reliable manner without mixing layered drinks.

2. Description of the Prior Art

Many patents address issues related to dispensing layered drinks or beverages into a glass. Several of these patents relate to producing layered drinks of different colors, which contact the sidewalls of one or more chambers resulting in mixing of individual drink colors resulting in turbid color patterns. Turbulence during pouring also results in mixing of drink colors resulting in a murky drink layering. In addition any turbulence in drink pouring step entraps air bubbles in individual layers of layered drink presenting unsightly appearance.

U.S. Pat. No. 654,879 to Dineen discloses a device for dispensing beverages and comprises a jigger with an inner and outer casing. The inner casing carries the selected liquor, held by a bottom valve that opens by rotating the outer casing. The outer casting carries the valve and its rotation lowers the inner casing by the action of a notch opening the valve. The liquor is poured over a distribution disk and liquor runs over the top surface of the disk into the glass being filled. The liquor is on a free fall with a high velocity and does not enter the glass gently since streaming of the liquor is possible. Moreover, the disk is immersed in the liquor being filled. Consequently, removal of the disk results in changes to the layers of filled "beverage" including mixing of colors and/or entrapment of air bubbles.

U.S. Pat. No. 1,664,266 to Del Rio discloses a funnel. This funnel is a device for conveniently filling a bottle with liquid. The funnel apparatus is provided with a central opening and a valve at its lower end that is closed by a floating valve mounted on a wire that passes through the central opening. The wire that passes through the central opening is not in close intimate contact with the opening and does not assist in transporting the liquid through viscous flow, rather the liquid flows through the central opening at a rapid rate. This is not a device for filling glasses with liquid forming multiple layered 'float' liquid beverages. The liquid is merely poured through the funnel and the float closes off the funnel central opening when the bottle is filled. The velocity of flow is rapid and turbulent disturbing the liquid already in the bottle and therefore the resultant drink does not have separate layers of liquids.

U.S. Pat. No. 2,740,571 to Busto discloses a measuring and dispensing device for making varied-layer drinks of different liquids. The dispensing device basically comprises an upper receptacle with multiple compartments for carrying measured quantities of several liquors, a valve arrangement, and a lower receptacle. The upper receptacle is turned to line up the discharge hole of one of the compartments with the valve arrangement to discharge the liquor into the lower receptacle. From the lower receptacle the liquor is discharged into the glass that is being filled. Since liquors sequentially enter the same lower receptacle, residues of previously poured liquor mix with the currently poured liquor preventing clean pour of thin layers in a float liquor beverage. Since the liquor is directly poured from the second receptacle, it pours with a high velocity, disturbing previously poured layers of liquor.

U.S. Pat. No. 2,771,913 to Flasnöcker discloses a beverage mixer whereby liquid layers are formed. Basically, the apparatus of the invention is a funnel with a flared inset tube having a notched bottom tip. The funnel is placed on a glass that is being filled with layers of cordial liquor with the notched slide-able inset tip resting at the bottom of the glass. The lowest density liquor is poured first followed by next higher density liquor, causing the first layer to float over the second higher density liquor. Subsequent pouring of sequentially higher density liquor produces a layered float liquor beverage. The liquor is directed to the bottom of the glass so that the lower density liquor is forced to rise up. This movement in liquor may not produce a clean separation, especially if the poured liquor is delivered at a high velocity. The funnel has no means to adjust the pour velocity and therefore the mixing of different layers of cordial liquor may be unavoidable, especially if the pouring rate is reasonable.

U.S. Pat. No. 3,185,189 to Reid discloses a device for use in the preparation of layer drinks. It has a pouring device placed on the upper rim of a glass that is being filled with layered liquor drink and comprises a floatable semi ball attached to a central rod, which passes through a support. The floating semi ball has nearly the same diameter as the glass so that when the liquor is poured over the flat surface of the floating semi ball the liquor is directed to the wall of the glass providing a gentle pour to establish the layers. Since the liquor wets the walls of the glass and is at a higher level than the liquor level in the glass, the glass surface is contaminated with liquors of different color proving poor layering of the float liquor beverage. The velocity of pour is not reduced by the external surface of the semi ball and may even splash the liquor in an uncontrolled manner. Moreover, the device does not provide for any stabilization for the glass, therefore the glass with the device attachment may readily topple over and spill the liquids contained therein. The device does not have a built-in conical shaped pouring cup to facilitate convenient neat pouring of the liquid.

U.S. Pat. No. 4,050,484 to Danyo (discloses an apparatus for controlling the flow of liquor into a glass so as to form a drink having separate layers. The disclosed device is comprised of a funnel-like upper cup portion with a large upper end or opening to receive liquids, and a smaller lower end attached to and surrounding a shaft portion. Relatively small openings are provided between the lower end of the funnel-like cup portion and the shaft portion to allow a liquid to escape from the funnel-like cup portion at a relatively slow rate, and run down the sides of the shaft. When the lower end of the shaft portion is immersed in another liquid, the liquid flowing down the sides of the shaft will meet and spread out over the surface of the other liquid if the one liquid is less dense than the other liquid. The disclosed device has a funnel with a hole in its bottom to which a twisted shaft is welded. When the liquid is poured into the funnel, it flows down into a glass through the hole and along the length of the twisted shaft via gravity forming a separate layer. The velocity of flow is determined by the hole size in the funnel and the length of the shaft. This free running liquid may have sufficient velocity to create bubbles and eddy in the liquid contained in the glass, resulting in disturbance to already poured liquid layers. Since the funnel is unsupported and is not stabilized, any slight movement of the funnel during pouring of the drink layers disturbs the layer lay up within the glass.

U.S. Pat. No. 4,126,164 to Magnifico discloses a device for use in preparing varied layered drinks. The device includes a cup member for placement on the rim of the glass in such a manner that a substantially airtight seal is formed between the glass and the bottom of the cup member. Pluralities of fluid passageways are located in the bottom of the device to allow fluid to pass from within the cup member to the interior of the glass. These fluid passageways are angled downward and outward so as to direct the fluid passing there through substantially against the inner walls of the glass so that the fluid will run down the inner walls of the glass rather than merely falling or dripping onto the surface of any fluid already in the glass. In this manner, the incoming fluid will not break the surface tension of the fluid already present in the glass but, rather, will float on this fluid to create a varied layered drink. An air vent is provided in the bottom of the cup member to allow air to pass out of the glass as fluid flows through the fluid passageways. The device uses an airtight cup which fits into a glass into which a liquor drink is first poured to create a layered drink. The air vent is released, at which point, the poured liquor is directed downward and outward through passages provided in the cup. Since liquors poured are always directed to the wall of the glass, the boundary layer at the wall invariably has the color of the previous layer and when a new layer is poured colors are mixed. Therefore the layered liquor drink is not prepared with clean colored layers but is murky at the glass-layered drink interface. Also, the valve release mechanism via of an air vent has to be manually released by the pourer and the velocity of entry of the poured drink into the glass is essentially uncontrolled and may result in unexpected disturbance of the drink layer created.

U.S. Pat. No. 4,337,806 to Cirella discloses a liquid dispensing device, which is device for making multi-layered drinks, and more particularly to a liquid dispensing device for dispensing one liquid to float upon another liquid. It attaches to a liquid bottle using screw threads and has internal passages that are connected to a valve for controlled delivery of the liquid to a glass. The device is mounted on a stand with the dispensing tubular member. The dispensing tubular member has a cap attachment placed at a height so that it is in contact with the previously poured liquid layer. The valve is turned to activate the flow of liquid, which flows through the dispensing tubular member and exits from the top surface of the cap attachment so that the liquid is poured above the previous layer. The liquid flow has to be manually controlled by activating the valve and too much flow results in the disturbance of previously poured layers. Removal of the cap from the poured liquid by raising the stand also disturbs the poured layer. The device disclosed is large and cumbersome. The bottle of liquor is suspended from a stand and is not manually poured. Furthermore, the liquid travels into the glass being poured by way of free flow, not a viscous flow.

U.S. Pat. No. 4,469,151 to Wilson et al. discloses fluid layering device. This fluid layering device uses a syringe to facilitate layering a liquid from the syringe onto a denser liquid contained in an open-top centrifuge tube. This device is constructed for use with a liquid dispenser, to facilitate layering a liquid from the dispenser onto a denser liquid contained in an open-top tube. A fitting in the device is releasably attachable to the dispenser for receiving the liquid. A nozzle carried on the fitting has an outer opening and a flow-constricting bore communicating the opening with liquid received in the fitting. Positioning structure in the device is adapted to hold the nozzle at an operative position with respect to the centrifuge tube. At this position, the nozzle opening confronts, and is spaced from, the tube's inner wall by a defined clearance which is adapted to produce, with liquid being forced from the dispenser through the bore in the nozzle, a controlled-flow ribbon of liquid down the wall of the tube onto the upper surface of the denser liquid in the tube. This device delivers liquid contained in a pressurized syringe to a open top centrifuge tube. This device does not pour liquor drinks in multiple separated layers.

U.S. Pat. No. 4,800,934 to Boissoneault discloses a device for pouring drinks having layers of different densities. This device for pouring layered drinks comprises a base portion in the form of a tray defining four recesses onto which four separate glasses can be located. The device has a support member with a support surface that can rest upon the rim of four glasses. A cup member is carried on the support member and projecting downwardly relative to the support surface projecting into an interior of the glass. The cup member has an open top into which a liquid can be poured. The poured liquid collects at the closed base of the cup and is discharged through orifices provided at the cup base. The orifices are confined to one angular location around a periphery of the cup to engage the discharged liquid to the outer surface of the glass. This device pours liquor into four different cups that fit into four different glasses and is discharged through orifices in the bottom of the cup. The liquid pour velocity aims the liquid jet towards the wall of the glass and the high jet velocity can disturb liquor layers.

U.S. Pat. No. 5,163,488 to Basch discloses an apparatus for preparing foodstuffs and drinks having separate liquid layers. The device is for providing superposed layers of liquids of different densities. It comprises a body that is mounted on a glass, wherein the body is filled with liquids through a receptacle having a discharge channel. The liquid is delivered through the discharge channel located at the bottom of the receptacle. Particularly, the body has a spherical float that is connected to a rod. The liquid travels down the rod to the spherical float and is delivered to the glass, thereby forming superposed layers of liquids. The float is preferably provided with a specific surface treatment, which confers superficial microporosity and a roughness. This can be accomplished by applying a mixture of silica and ammoniacal detergent to the float. Such a surface treatment ensures complete laminar flow of the liquid over the entire surface of the float and thus a perfect distribution of the liquid by layers, without eddies. The apparatus disclosed sits on the top rim of the glass to which the beverage or food item is to be contained. The apparatus does not provide for any stabilization of the glass. Therefore, when the apparatus is placed over the rim of the glass a disproportionate weight distribution results, with a heavier weight localized on the top portion of the glass. As a result, the glass and apparatus may readily topple over causing spillage of the liquids and even breakage of the glass. Furthermore, the apparatus of the invention can only be utilized on a glass having the specific diameter of the apparatus, as the apparatus is size specific and cannot be adjusted to fit varying glass sizes. The apparatus comprises a conical receptacle having a channel containing a rod, which terminates on a float. Special superposed conical cross sections are used between the rod and the float to distribute the liquid uniformly. In addition the float is provided with microporosity formed by treating the float's surface with a mixture of silica and ammonical detergent to improve the wetting characteristics of the liquid. The ratio of dimensions of the channel to the rod diameter is 1.7 (col. 3 line 35) with a rod diameter of 2 mm terminating on float, which is 42 mm (col. 3 line 37). These large dimensions of the channel, the rod diameter and the size of the float, results in a large volume flow that is characterized to be laminar (col. 4 line 62). Moreover, the connection between the float and the rod is effectuated by a junction portion formed by two superposed truncated cones and an annular throat. The liquid must traverse down the rod and over this junction portion before reaching the spherical float. This device is tailored for delivering liquids not liquor since silica mixed with ammonical detergent is used. Although these additives promote wetting and distribution of liquids over the float, they are clearly unsuitable for delivery of liquors.

U.S. Design Pat. No. D 317,103 to Case discloses an ornamental design for a drink layering spoon. This ornamental spoon has a reservoir shaped similarly to a funnel. A liquid is poured into the reservoir. The reservoir is connected to a tubing which carries the liquid to a curvature spoon portion where the liquid accumulates and subsequently flows into a vessel. The funnel has a bent edge that matches the layout and contours of the spoon handle. Any liquid poured into the funnel is delivered to the spoon via a tube extending from the bottom of the funnel into the spoon basin. The spoon may be used to set drinks in separate layers. The liquid is not delivered in a convenient, uniform manner into a drinking glass since the operator's hand stability is extremely important. It is a tedious process of layering liquid drinks, and the pourer will have to hold the spoon with care while attempting to pour the liquid and keep the spoon and glass stable.

There remains a need in the art for a device that reliably pours various drink layers without mixing between layers, and which maintains smooth attractive coloration of individual layers without creating entrapped air bubbles in any of the layers. The device should be easy to use by a single person and operate to layer drinks on a variety of differently sized glasses.

SUMMARY OF THE INVENTION

The present invention is directed to a drink layering apparatus that fits over a glass and gently delivers individual layers of drink, creating a layered drink with clear unmixed well separated layers of liquor or other drink compositions that are free from entrapped air bubbles.

Generally stated, the invention comprises a drink layering potion machine used for making drinks having a plurality of separate layers composed of different liquids. These separate layers may further comprise different colors, different compositions, and the like. The drink made with the drink layering potion machine may include one or more layers consisting of an alcoholic or non-alcoholic liquid. After the drink has been made, the layers remain separate and do not mix, owing to the different densities of the respective liquids. The finished drink is appealing to the eye as well as the palette.

The drink layering potion machine is comprised of a cylinder having an integrally attached, built-in conical pouring cup that has an aperture at the bottom, a thin rod that passes through the aperture at the bottom of the conical pouring cup, and a float or a ball float connected to the thin rod. The float may be of the shape of a ball, an inverted cone or an inverted bell. The cylinder is used to stabilize the drink layering potion machine completely surrounding a glass into which the drink is being layered, as the glass and the cylinder rest on a flat tabletop or bar top. During use, a glass is positioned on a flat surface first and the cylinder of the device is positioned over the glass, so that the flat bottom of the cylinder rests on the surface, thereby shrouding and stabilizing the glass. Next, the various liquids are individually poured into the built-in pouring cup. The liquid is guided along the tapered edges of the integrally attached built-in pouring cup and flows out of an aperture located at the bottom of the pouring cup, which surrounds a thin rod with a close tolerance. The liquid then flows down along the thin rod passing through the aperture located on the bottom of the built-in pouring cup until it reaches a float or ball float positioned at the bottom end of the thin rod. The liquid adheres to the thin rod due to wetting action and flows downward towards the ball assisted by gravity as a viscous flow, and this flow rate is quite small and therefore not turbulent and does not include air bubbles. The diameter of the thin rod may range from 1 mm to 5 mm (0.04 to 0.125 inch), preferably a thin rod having a diameter of 3 mm or 0.125 inch. The aperture on the bottom of the conical cup has a diameter, which is 0.1 to 0.3 mm (0.004 inch to 0.2 inch) greater than the diameter of the thin rod. The small diameter float is buoyant and floats over the current liquid level in the glass that is being filled. The diameter of the buoyant ball may range from 12.5 to 35 mm (0.5 to 1.5 inches). The float is also wetted by the liquid drink that is being poured and will guide the liquid as it comes to rest in the glass, thereby forming one of the layers of the drink. A float having a surface finish similar to a ping-pong ball allows smooth non turbulent flow on its external surface providing optimal drink pouring conditions.

The process is repeated for each liquid layered and the drink is complete. The exact sequence of pouring the various liquids is properly selected based on the densities of the various liquids, so that they remain separated once they are poured into a glass. That is, the densest liquid is poured into the glass first, then the next most dense liquid, and so on.

Optionally, fins are located around the bottom-tapered edges of the cup. These fins are adapted for stabilizing the glass used to contain the resulting layered drink. The diameter of the aperture in the built-in pouring cup is larger, but not much larger, than the diameter of the thin rod in order to allow the thin rod to slide up and down inside the aperture and allow a thin film of poured liquid to flow along the thin rod and pass through the aperture. The cylinder may be formed from a transparent material, such as clear plastic or glass, or alternatively from a colored material. Optionally, the cylinder of the device may include up to four cutout channels, which will allow the ability to see the fill level of the glass at any time while making the drink. The optional cutout channels are more preferred when using a colored cylinder, since the coloring will diminish the ability to see through the cylinder.

The drink layering potion machine is suitable for use in a bar or restaurant, and is also suitable for home use. The drink layering potion machine is very easy to use and is fun for both the operator and the viewer(s) of the device. Advantageously, drinks having separated layers are readily poured without disturbance of the different drink layers without inclusion of air bubbles and unsightly defects.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Figure 1:
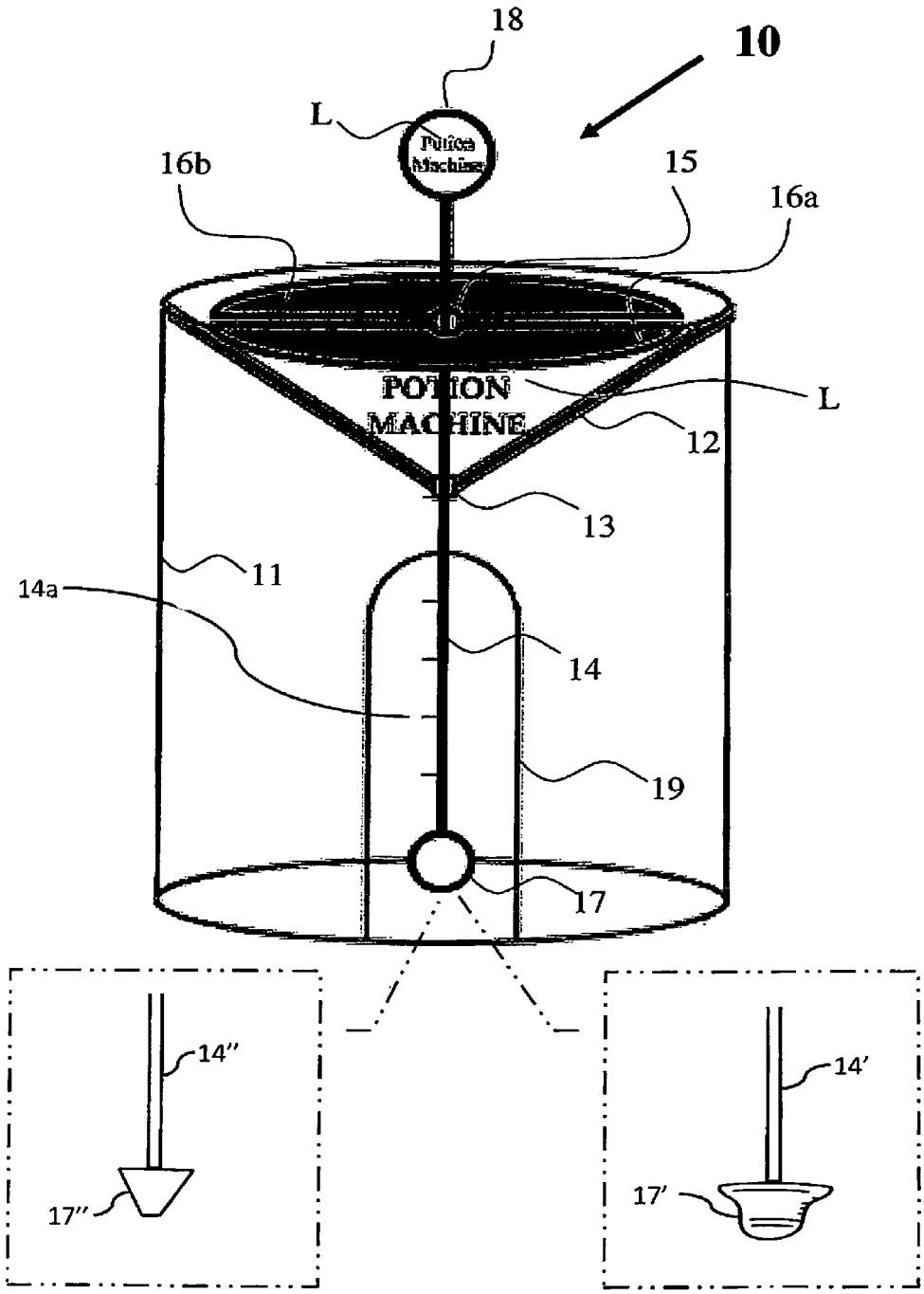
FIG. 1 is a schematic view of the drink layering potion machine.

The present invention relates to an apparatus for making drinks, and more particularly to a drink-layering potion machine especially suited for making a drink having a plurality of separate layers composed of different liquids. The liquids constituting the separate layers of the drink have different densities and may further be comprised of varying colors, compositions, and the like. One or more of the liquid layers of the drink may consist of an alcoholic liquid. After the drink has been made, the liquids remain separated, thereby yielding distinct separate layers. The layers do not mix, owing to the different densities of the respective liquids. Advantageously, the finished drink is appealing to the eye as well as the palette; and it is readily made to order on a moments notice.

Generally stated, the drink layering potion machine is comprised of a separation chamber unit acting as housing to hold a glass, wherein the glass is filled with varying liquids and thereby contains the finished layered drink. The separation chamber unit includes a cylinder having an integrally attached built-in pouring cup, a thin rod, and a float or a ball float connected to the thin rod. The cylinder has a cavity on the bottom portion of the cylinder so that a glass can be housed therein. The cylinder stabilizes the drink by housing the glass in place as the cylinder and the glass rest on a tabletop or bar top. Specifically, when the drink is being made a glass is positioned on a flat surface and the cylinder is positioned over the glass so that both the glass and the bottom portion of the cylinder are flush against the surface, thereby stabilizing the glass and the separation chamber unit. Next, the various liquids are individually poured into the pouring cup one at a time. This pouring cup has a conical shape having tapered edges, resembling a funnel structure. The liquid is guided along the tapered edges of the pouring cup and flows out through an aperture located at the bottom of the pouring cup, which surrounds a thin rod with a close tolerance.

The liquid then flows down along the thin rod that passes through the aperture in the bottom of the pouring cup until it reaches a float or ball float positioned at the bottom end of the thin rod. The top portion of the thin rod extends upwards through the aperture and into the pouring cup. The bottom portion of the thin rod extends downward through the aperture and into the bottom portion of the cylinder. This thin rod may be composed of metal, plastic, or glass. The liquid adheres to the thin rod due to wetting action and flows downward towards the ball assisted by gravity as a viscous flow and this flow rate is quite small. The small diameter float is buoyant and floats over the current liquid level in the glass that is being filled. The float is also wetted by the liquid that is being poured and will guide the liquid as it comes to rest in the glass, thereby forming one of the layers of the drink. The wetting action of the liquid on the thin rod and the floating ball causes a drink boundary layer to be retained. In particular a satin surface finish such as that of a ping-pong ball allows the poured liquid to wet the external surface of the ball and flow smoothly. When an adequate first layer of liquid is built up inside the glass, the float begins to float above the first layer poured and floats to higher heights within the glass as more layers are built up. This upward movement of the float does not disturb the previously poured layers since this movement is very slow and gentle.

The flow of poured liquid on the thin rod and the surface of the floating ball is analogous to fluid flow in a region very close to a boundary layer and could be termed as a constrained viscous flow. This flow is assisted by gravity and is usually small in volumetric rate. It is not a free laminar flow, which usually has much higher volumetric flow rates. As a result, poured liquid flows into the glass at very slow volumetric rates and gently disperses on the surface of the glass by the small ball. The small ball, which has a diameter up to 35 mm, occupies a small area of the liquid's surface and results in a lower degree of disturbance to the lower poured liquid layer.

The other end of the thin rod opposite to the floating ball carries a second ball, which may carry a logo such as 'Potion Machine'. This second ball prevents the thin rod from being removed from the aperture. When the drink layering potion machine is being used the floating ball floats on the surface of the last layer of liquid poured in the glass and the ball on the opposing end of the thin rod indicates the level of the liquid in the glass. As more liquid is poured the ball floating on the surface of the liquid and located on the bottom end of the thin rod rises, indicating that the liquid level in the glass has increased. A measuring device may optionally be provided to accurately quantify the level or volume of liquid contained within the glass.

FIG. 1 shows the schematic arrangement of the drink layering potion machine at 10. A cylinder 11 has a top portion with a top rim 11*a* and a bottom portion. A pouring cup 12 is built-in the top portion of the cylinder 11. The pouring cup 12 has a pouring cup rim 12*a* that abuts the to rim 11*a* of the top portion of the hollow cylinder 11 so that the pouring cup 12 is housed inside/built-in the hollow cylinder 11 as depicted in FIG. 1. This pouring cup 12 has a conical shape having a reservoir with tapered edges so that the flow of liquid is gravitationally directed towards the bottom of the pouring cup's 12 reservoir wherein an aperture 13 is located. A thin rod 14 extends downward through the aperture 13. A second aperture 15 is provided in a bar (not shown) or two piece cover 16*a* and 16*b* which provides a second support for the thin rod preventing its movement. The bar or, in the alternative, the two pieces 16*a* and 16*b* rest within the pouring cup portion. When a drink is poured into the pouring cup, the bar remains in place, and the two pieces 16*a* and 16*b*, if used, may be removed prior to pouring of the drink. On the other hand, they optionally may not be removed and the poured drink pours through the slot between the two pieces 16*a* and 16*b*. The apertures 13 and 15 have a diameter that is only slightly greater than that of the thin rod 14 approximately 0.1 to 0.3 mm. The thin rod 14 extends through and is inserted into the aperture 13 and captured by the second aperture 15 preventing any wobbliness of the rod as drink is poured into the glass which raises the level of the ball typically over sized with respect to the thin rod diameter by The diameter of 10 the thin rod 14 may range from 1 to 5 mm. Hypothetically, when thin rod 14 has a diameter of 3 mm, the aperture 13 has an opening of 3.1 mm. The area of this aperture in $mm^2$ is given by $$\frac{\pi}{4}(3.1^2 - 3^2)$$

or 0.479 $mm^2$ or 0.00479 $cm^2$. When the initial head of liquor in the cup is 1 cm high, the velocity in cm per second at the conical aperture is given by $\sqrt{2g}$ or 44 cm per second. Thus the volume delivered is 0.21 cc per second. A one-minute fill for a layer delivers 12.6 cc and this is a slow delivery of the liquid and generally lamellar, not turbulent. Depending on the liquid pour height in the conical cup, selection of aperture diameter and thin rod diameter the flow rate may range from 0.1 cc per second to 2 cc per second. As the liquid head decreases in the conical cup, the velocity at the aperture-thin rod interface decreases according to the equation detailed and a smaller volumetric rate of liquid is delivered to the thin rod. As a result, the liquid is delivered as a clean layer that does not disturb previously laid layers and is free from air bubble entrapment.

The bottom end of the thin rod 14 is permanently attached to a small diameter floating ball 17, inverted cone (as shown in the cut-out view at 17' on thin rod 14'), or inverted bell float (as shown in the cut-out view at 17" on thin rod 14"). The floating ball 17 may have a diameter in the range of 12.5 to 35 mm. Both the thin rod 14 and float ball 17 are made from a material that is readily wetted by the liquid that is being poured. Specifically, the material composing the thin rod 14 and/or the floating ball 17 may be of metal, plastic, glass, or any other suitable material. The thin rod 14 may have graduation markings 14*a* indicting height of poured later in the glass.

Continuing on with FIG. 1, the opposing end of the thin rod 14 carries a suspending second ball 18 that is similar to the floating ball 17. This suspending second ball 18 is located at the top of the thin rod 14 and functions to prevent the thin rod 14 from falling through the aperture. Like the floating ball 15, the suspending second ball 18 may be made from the same material as the thin rod 14, or made from a different material. The material composing the suspending ball 16 may be stainless steel, plastic, glass, or any other suitable material. Optionally, the suspending second ball 18 may be decorative so as to carry a design, color, shape, or logo such as 'POTION MACHINE' shown at L. The suspending second ball 18 may be composed of the same material and/or structure as the floating ball 17. The floating ball 17 may be made from a thin walled stainless steel, glass, or polymeric material, whereby the inner portion of the floating ball 17 is filled with air to facilitate buoyancy of the floating ball 17 in liquid contained by the glass. Alternatively, the floating ball 17 may be made from material that has a low density, such as a foamed polymeric material or the like. However, the surface of a foamed polymeric ball must be impervious to liquids so that poured liquid is not contaminated by liquids retained in the floating ball 17, while allowing the floating ball 17 to be easily washable.

The cylinder 11 can slide over a glass that is being poured with layered liquid. The cylinder 11 may be conveniently made from a transparent material so that liquid fill in the glass may be readily observed. Optionally, a cutout as shown at 19 may be provided for observing the layering of liquid in the glass. A logo may be printed on the Potion Machine as shown at L.

Figure 2:
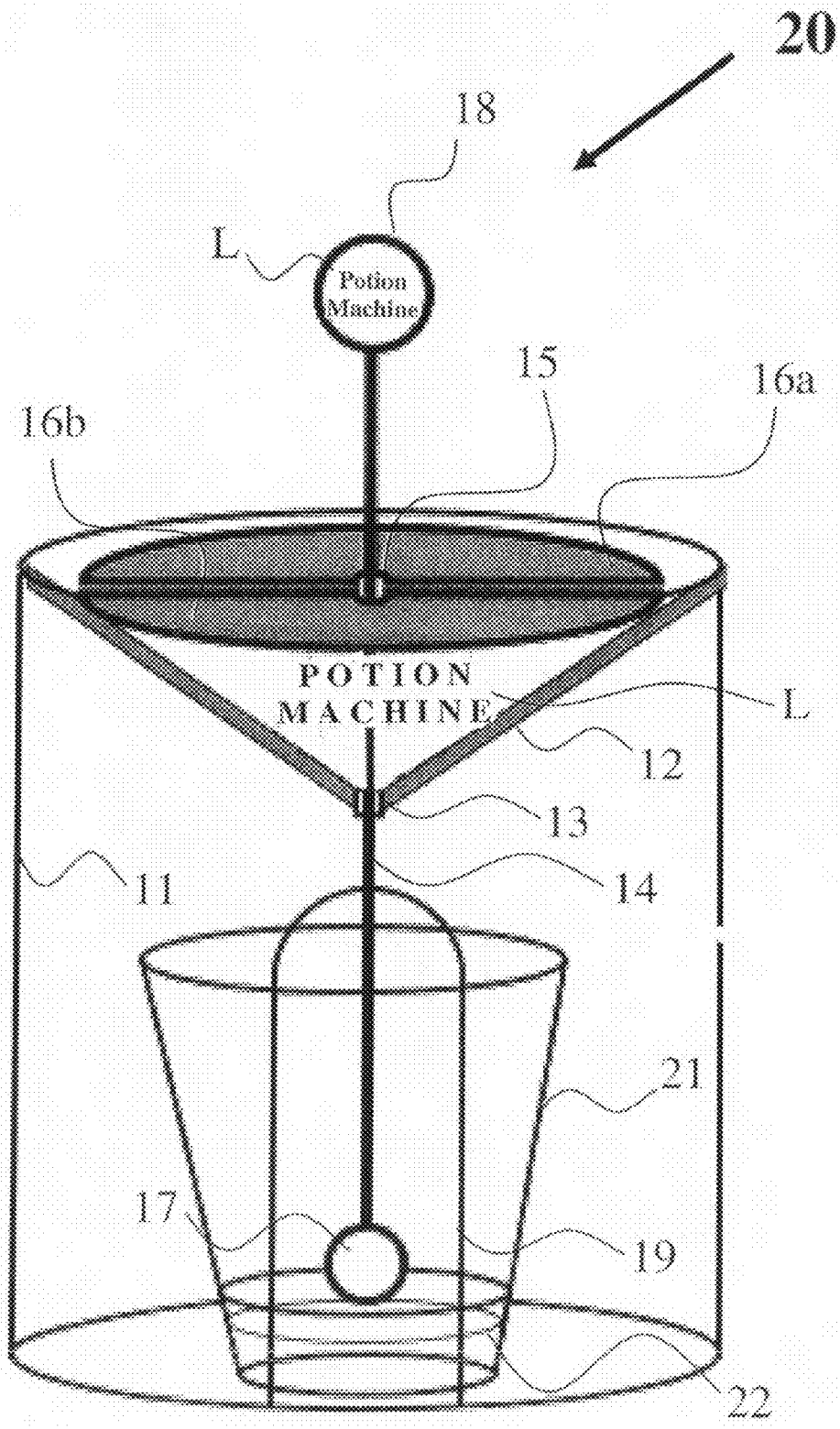
FIG. 2 is a schematic view of the drink layering potion machine when placed on a glass that is being filled with a drink layer.

FIG. 2 shows the drink layering potion machine 20 in use with a glass 21 temporarily housed therein and being filled with layered liquids. The glass is first filled with the heaviest or densest first layer of liquid. When the cylinder 11 is placed over the glass 21, the floating ball 17 is located inside the glass 21 and resting on the first layer of liquid 22 therein. The suspending second ball 18, located on the opposing end of the thin rod 14, is now at a location above the rim of the pouring cup 12. Now the rod and/or the two pieces 16*a* and 16*b* are placed within the conical pouring cup 12 and the two pieces 16*a* and 16*b* form an aperture 15 within which the thin rod 14 moves up and down freely without any wobbliness. When the liquid layers of are poured the level in the glass 21 rises. Correspondingly, the floating ball 17 floats in the liquid and is elevated to a higher level. Similarly, the suspending second ball 18 is raised to a proportionate higher level. Thus suspending second ball 18 gives a visual indication of the amount of liquid poured. Optionally, a measuring device (not shown), i.e. a ruler, may be provided to indicate the liquid level in the glass 21. After the heaviest density liquid is poured into the apparatus and contained in the glass forming the first layer of the drink, the liquid of next lower density is poured into the pouring cup 12 either first removing the two pieces 16*a* and 16*b* or allowing the poured liquid to flow around the support rod or the two pieces 16*a* and 16*b*. Again, this liquid wets the thin rod 14 and passes through the aperture 13 through the small clearance between the aperture 13 and the thin rod 14. The liquid clings to the surface of the thin rod 14, due to wetting action, and gravitationally flows downward via viscous flow towards the floating ball 17. This viscous flow is not similar to free laminar flow and is almost similar to fluid motion adjacent to a thin boundary layer. When the liquid encounters the floating ball 17, it spreads all around the surface of the floating ball 17, since the floating ball 17 is wetted by the liquid. The floating ball 17 facilitates the liquid's gentle dispersion into the glass 21 as the liquid migrates on top of the denser liquid already contained by the glass 21, while retaining uniform, separate layers.

Since there is no rapid free flow of the liquid, either on the thin rod 14 or on the floating ball 17, the liquid is delivered to the glass 21 with minimal velocity. Due to the slow velocity, consecutive liquid layers gently form as the liquids spread over previously poured layers with practically no eddy currents. Hence the previously poured liquid layer is not disturbed and remains homogeneous and uniform. Since there are no valves in the system, the quantity of liquid poured in the pouring cup 12 is exactly the same as that delivered to the glass 21. Liquid layers are poured with progressively decreasing density so that the subsequent layers float on previously poured layers.

Figure 3:
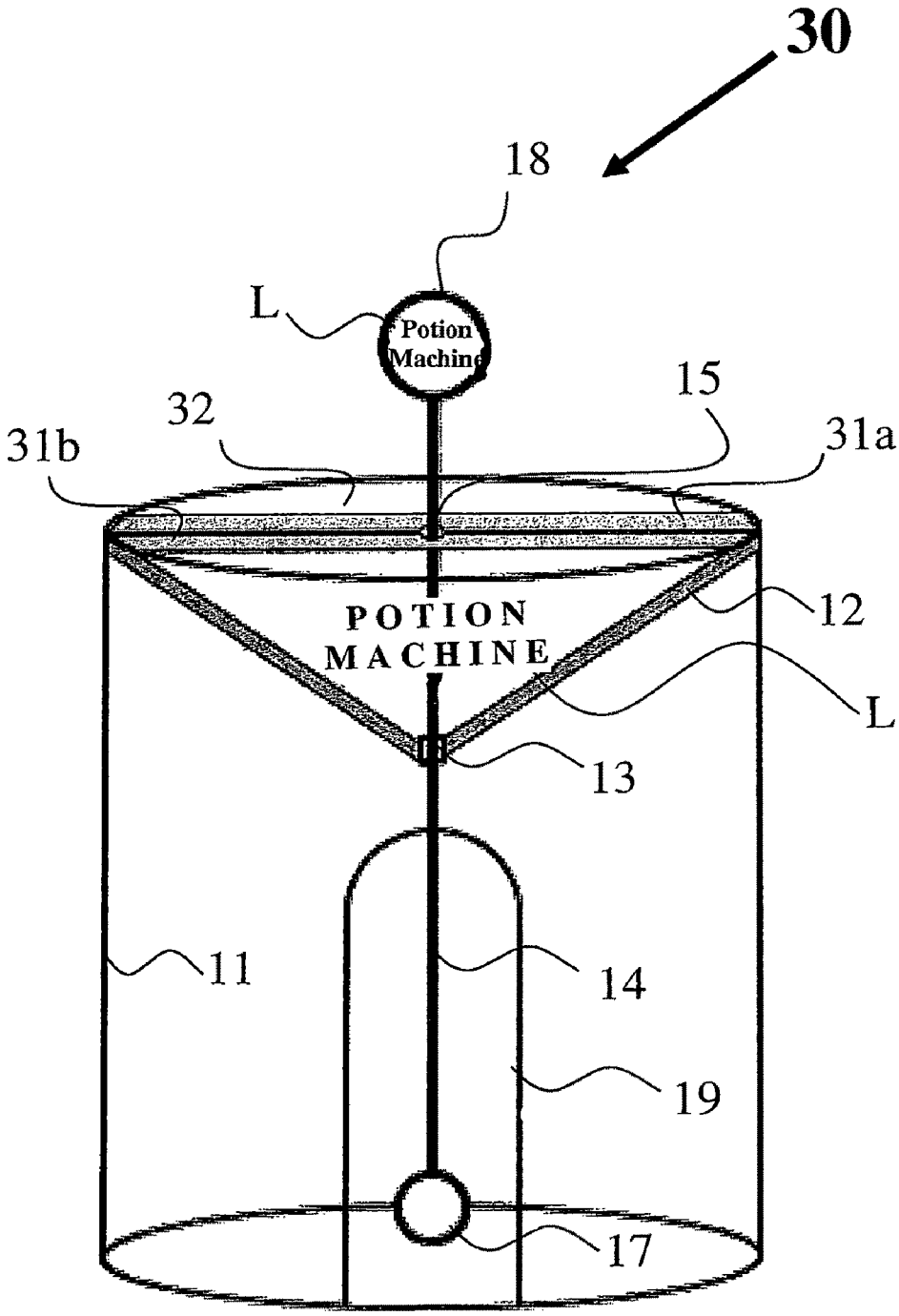
FIG. 3 is a schematic view of an alternate embodiment of the drink layering potion machine.

FIG. 3 shows the schematic arrangement of an alternate embodiment of the drink layering potion machine at 30. In place of the two pieces 16*a* and 16*b*, which define the second aperture 15, a structural element with a central aperture, such as two bars 31*a* and 31*b* are used which create a central aperture 15. The bars 31*a* and 31*b* snugly fit on the edge of the pouring cup 12 as shown. The area shown at 32 is available for pouring the liquor into the pouring cup 12.

While the second aperture depicted in FIGS. 1, 2 and 3 employs two pieces that join together to form the aperture for stabilizing the movement of the thin rod, the same functionality may be achieved by a number of configurations. For example, the second aperture may be provided in a plate that is welded to the pouring cup keeping a selected spacing between the first and second aperture. This spacing between the first and second aperture may be in the range between 6 mm to 25 mm.

Significant advantages are realized by practice of the present invention. Layered liquid drinks, which are tasty and attractive, can be produced by any unskilled person with reliable results. There is practically no intermixing of the various liquid layers. The separation of the liquids is clearly defined and visible when translucent glasses are used to contain the finished drink. The liquids' abilities to retain separate distinct layers is due to the complete absence of eddy current cells in the preceding layers as later layers of liquid are poured sequentially.

The method of manufacture of the drink layering potion machine is dependent on the materials used for its construction. The cylinder with the pouring cup that contains the first aperture may be an injection molded polymeric body. It may have the second aperture molded at a fixed distance, held in place by a plurality of spaced pillars that support a plate carrying the second aperture. The thin rod may be metallic or polymeric rod with the floating first ball integrally attached while the suspending second ball may be removably attached, for example by press fit or screw threads and the like.

The drink layering potion machine comprises, in combination, the following salient features:

1. a hollow cylinder having a top portion and a flat bottom portion;

2. a pouring cup "built-in" the cylinder, the pouring cup being located within the top portion of the cylinder and having a conical shape;

3. a first aperture located at the base of the pouring cup, the aperture being formed as the walls of the pouring cup taper down towards the base;

4. a thin rod with a diameter in the range of 1 to 5 mm inserted and extending through the first aperture so that there is a small gap between the thin rod surface and the walls of the first aperture;

5. the thin rod passing through a second aperture that is spaced at a distance from the first aperture providing support for the thin rod and preventing its wobbly movement;

6. the first and second aperture having a diameter that is only slightly larger (~0.1 to 0.3 mm) than that of the thin rod;

7. the thin rod having a top end and a bottom end;

8. a first floating ball or inverted cone or bell float or positioned at the bottom end of the thin rod;

9. a suspending second ball attached to the top end of thin rod restraining the thin rod from falling out through the first aperture;

10. the float having a dimension of 12.5 to 35 mm;

11. a poured liquid delivered to the thin rod through the gap between the first aperture and the thin rod, the liquid being delivered at a slow rate, determined by the wetting action;

12. the poured liquid being delivered to the floating ball surface at a slow rate by way of viscous flow; and 13. the poured liquid distributing uniformly on the external surface of the floating ball by wetting action, and flowing by way of viscous flow to the glass, thereby forming a separated drink layer.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A drink layering potion machine, comprising:

a. a hollow cylinder having a top portion with a top rim and a flat bottom portion;

b. said top portion having an integrally attached "built-in" conical pouring cup, said pouring cup having a top section with a pouring cup rim that abuts said top rim of said hollow cylinder so that said pouring cup is housed inside said hollow cylinder;

c. bottom tip at the base of said conical pouring cup having a first aperture to receive a thin rod;

d. said thin rod fitting into said first aperture with a small clearance;

e. said thin rod passing through a second aperture located substantially at said top section of said pouring cup and being spaced at a distance from said first aperture providing support for the thin rod and preventing its wobbly movement;

f. said thin rod having an integrally attached inverted cone, inverted bell float or float ball at the distal end;

whereby a poured drink into said conical pouring cup is expelled at a small volumetric rate by gravity through the clearance between said first aperture and said thin rod and guided over said thin rod on to the external surface of said inverted cone, inverted bell float or float ball to fill a glass stabilized by said hollow cylinder creating undisturbed layers of drink.

2. A drink layering potion machine as recited by claim 1, wherein said thin rod has a diameter in the range of 1 mm to 5 mm.

3. A drink layering potion machine as recited by claim 1, wherein said first aperture is larger than the diameter of said thin rod with a diameter clearance of 0.1 mm to 0.3 mm.

4. A drink layering potion machine as recited by claim 1, wherein said second aperture is provided at the joint line between two pieces that are placed at a distance of 6 mm to 25 mm from said first aperture within said conical pouring cup.

5. A drink layering potion machine as recited by claim 1, wherein said second aperture is provided in an integral plate within the conical pouring cup that is spaced at a selected distance of 6 mm to 25 mm from the first aperture.

6. A drink layering potion machine as recited by claim 1, wherein said inverted cone, inverted bell float or float ball has a dimension of 12.5 mm to 35 mm.

7. A drink layering potion machine as recited by claim 1, wherein said inverted cone, inverted bell float or float ball floats over layers of poured drink.

8. A drink layering potion machine as recited by claim 1, wherein said thin rod at its proximal end has a suspending second ball integrally attached that is distal from inverted cone, inverted bell float or float ball preventing thin rod removal from said first aperture.

9. A drink layering potion machine as recited by claim 1, wherein said thin rod has graduation markings indicting height of poured layer in the glass.

10. A drink layering potion machine as recited by claim 1, wherein said small volumetric flow rate of poured liquid into the glass is in the range of 0.1 cc per second to 2 cc per second.

11. A drink layering potion machine as recited by claim 1, wherein a highest density liquid drink is layered first progressively followed by lower density liquid drinks.

12. A method of using a drink layering potion machine for creating layered drink comprising the steps of:

a. placing a drink glass on a flat table top or bar top;

b. placing hollow cone of said drink layering machine on said flat table top or bar to thereby encase substantially the entire glass with float or float ball of said drink layering machine resting at the bottom on the interior of said glass;

c. pouring highest density liquid into the conical cup of the drink layering machine;

d. driving by gravity said poured liquid through a clearance between an aperture at the bottom portion of said, conical cup and external surface of a thin rod there within at a small volumetric rate;

e. delivering the poured liquid at a small volumetric rate on the external surface of the thin rod to the external surface of said float or float ball;

f. creating a layer of poured liquid in the glass by gentle flow of poured liquid over the surface of the float or float ball;

whereby the layers of poured drink are clear, undisturbed and free from air bubbles.

13. A method of using a drink layering potion machine as recited by claim 12, wherein said small volumetric flow rate of poured liquid into glass is in the range of 0.1 cc per minute to 2 cc per second.

14. A method of using a drink layering potion machine as recited by claim 12, wherein the drink layering potion machine is lifted from the glass and conical cup is washed and replaced over the glass between pouring of two colored layers of drinks.

* * * * *